United States Patent [19]

Koitabashi

[11] Patent Number: 4,959,688

[45] Date of Patent: Sep. 25, 1990

[54] IMAGE FORMING APPARATUS HAVING CHARGING AND DISCHARGING MEANS

[75] Inventor: Noribumi Koitabashi, Yokohama, Japan

[73] Assignee: Canon Kabushiki Kaisha, Tokyo, Japan

[21] Appl. No.: 259,700

[22] Filed: Oct. 19, 1988

[30] Foreign Application Priority Data

Oct. 19, 1987 [JP] Japan ..... 62-263106
Dec. 28, 1987 [JP] Japan ..... 62-336342

[51] Int. Cl.[5] ..... G03G 15/02; G03G 15/16
[52] U.S. Cl. ..... 355/219; 355/274
[58] Field of Search ..... 355/219, 221, 222, 223, 355/271, 274, 276; 430/902; 361/221, 225

[56] References Cited

FOREIGN PATENT DOCUMENTS 59-171971 9/1984 Japan ..... 355/219

*Primary Examiner*—Joan H. Pendegrass
*Attorney, Agent, or Firm*—Fitzpatrick, Cella, Harper Scinto

[57] ABSTRACT

Prior to formation of a latent image on a movable image bearing member, the latent image bearing member is charged to a predetermined potential. Then, the image bearing member is contacted to discharging means, by which the image bearing member id discharged so that a substantially uniform charge potential is provided on the image bearing member. The voltage V2 (V) (0 when grounded) applied to the discharging means, the surface potential V1 (V) of the image bearing member before being discharged by the discharging means, and the charge starting voltage $V_{TH}$ (V) of the image bearing member satisfy $|V1-V2| \geqq |V_{TH}|$ (V2=) when discharging grounded). By this, the charge moves from the image bearing member to the discharging means. The discharging means may be grounded or may be supplied with a voltage which is low enough not to charge alone the image bearing member. According to this invention, the absolute value of the surface potential of the image bearing member discharged by said discharging means is not dependent on the surface potential of the image bearing member before discharge, and can be made not less than $|V_{TH}|$. The necessity of conventional uniform discharging means before the primary charge is eliminated so that the cost and the size of the image forming apparatus can be reduced.

49 Claims, 12 Drawing Sheets

IMAGE FORMING APPARATUS HAVING CHARGING AND DISCHARGING MEANS

FIELD OF THE INVENTION AND RELATED ART

The present invention relates to an image forming apparatus such as an image transfer type electrophotographic apparatus or electrostatic recording apparatus, more particularly to an image forming apparatus wherein an image is formed through an imaging process including substantially uniformly charging a surface of an image bearing member such as a photosensitive member and a dielectric member to a positive or negative predetermined voltage, and the image is transferred onto a transfer material, wherein the image bearing member is repeatedly used.

The description will be made with respect to, as an example, an electrophotographic apparatus.

As is well known, an electrophotographic process includes the step of uniformly charging the surface of the photosensitive member. Almost all of the electrophotographic machines commercialized at present include a corona discharger mainly consisting of a wire electrode and a shield electrode. Also, the corona dischargers are widely used for discharging the photosensitive member or to transfer the image. However, the charging system using the corona discharger involves the following problems:

(1) High voltage application:

In order to provide 500–700 V of the surface potential, a voltage as high as 4–8 KV is required to be applied to the wire electrode. The discharger is bulky in order to maintain a large distance between the wire electrode and shield electrodes to prevent the leakage of the current to the shield electrode and to the body, and also use of a highly insulative shielded cable is inevitable.

(2) Low charging efficiency:

Most of the discharging current from the wire electrode is flown to the shield electrode, and only several percent of the total discharging current is flown to the photosensitive member which is a member to be charged.

(3) Corona discharge product:

By corona discharge, ozone or the like is produced, so that an image is easily blurred due to oxidation of the parts and ozone deterioration of the photosensitive member surface, this is particularly remarkable under high humidity conditions. In consideration of the influence of the ozone to human body, an ozone absorbing and/or decomposition filter and a fan or the like to flow the air to the filter are necessitated.

(4) Wire contamination:

In order to enhance a discharge efficiency, a discharge wire having a large curvature (generally 60–100 microns in diameter) is used. The wire surface attracts fine dust in the apparatus by the strong electric field and is contaminated thereby. The wire contamination leads to non-uniform discharge, resulting in non-uniform image. Therefore, the wire or the inside of the discharger has to be cleaned.

Recently, consideration is made not to use the corona discharger involving the above-described problems but to use a contact charging means as the charging means.

More particularly, a conductive member such as a conductive wire brush or conductive elastic roller is externally supplied with a DC voltage of approximately 1.5 KV or a superposed DC and AC voltage is contacted to the photosensitive member surface which is the member to be charged, so that the photosensitive surface is charged to a predetermined potential. Examples of such contact type charging means are disclosed in U.S. Ser. Nos. 131,585 and 159,917. Further reduction of cost and size of the charger are desired.

SUMMARY OF THE INVENTION

Accordingly, it is a principal object of the present invention to provide an image forming apparatus using a contact type charger wherein the size and the cost are reduced.

It is another object of the present invention to provide an image forming apparatus using a contact type charger by which an image bearing member can be uniformly and stably charged to provide good images.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Figure 11:
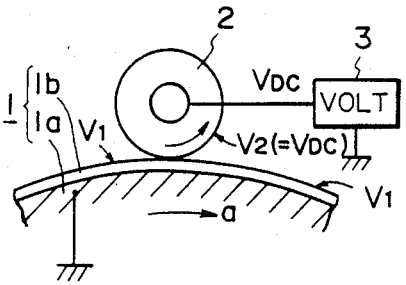
FIG. 11 illustrates a mechanism of contact type charging.

Referring first to FIG. 11, a part of an image forming apparatus is shown in cross section wherein an electrophotographic photosensitive drum 1 is partly shown as designated by a reference numeral 1. The photosensitive drum has a base member 1*a* made of aluminum or the like and a photosensitive layer 1*b* thereon. By rotating the photosensitive drum, its outer peripheral surface moves at a predetermined speed in a direction indicated by an arrow a.

The photosensitive layer 1*b* of the photosensitive drum 1 is a negative organic photoconductor material and has a carrier generating layer (CGL) containing azo pigment and a carrier transportation layer (CTL) containing mixed hydrazone and resin material having a thickness of 19 microns.

A conductive roller indicated by a reference 2 is a discharging member contacted to the surface of the photosensitive drum 1 under a predetermined pressure. It is rotated by the rotation of the photosensitive drum 1 with a predetermined pressure maintained therebetween. A voltage applying source 3 applies a voltage to the conductive roller. With this structure, a DC voltage $V_{DC}$ was applied to the conductive roller 2 to contact-charge the surface of the photosensitive drum 1, and the investigations were made as to the relations among:

a. The surface potential of the photosensitive member before passing by the conductive roller 2, that is, the surface potential before the contact-charging:

b. A DC voltage VDC applied to the conductive roller 2, that is, the surface potential V2 of the conductive roller 2: and c. The surface potential V of the photosensitive member after passing by the conductive roller 2, that is, after the surface of the drum is contact-charged.

Figure 12:
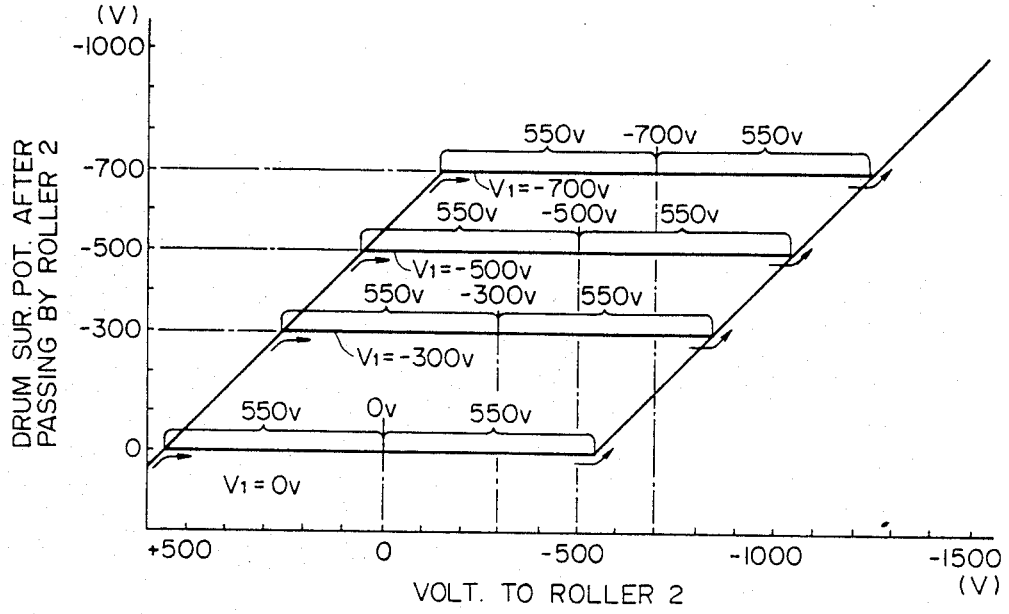
FIG. 12 is a graph of measurements of the photosensitive member surface potential V after the contact charging in relation to a voltage $V_{DC}$ applied to the conductive rubber roller with a parameter of the photosensitive member surface potential V1 before the contact charging.
Figure 13:
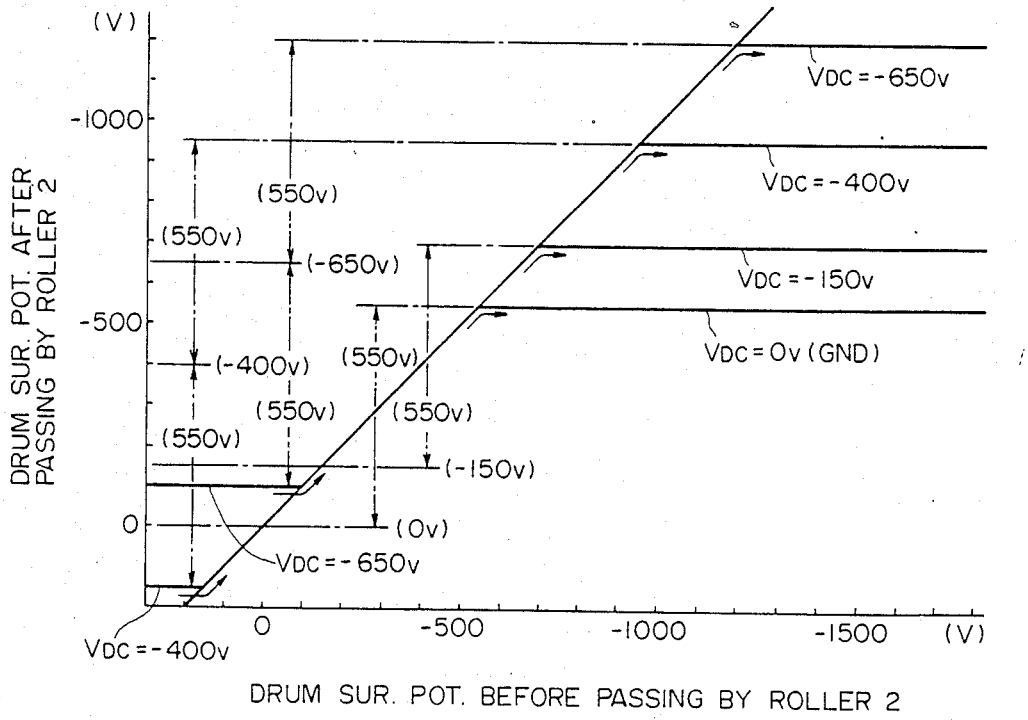
FIG. 13 is a graph of measurements of the surface potential V after the contact charging in relation to a photosensitive member surface potential V1 before the contact charging with a parameter of a DC voltage $V_{DC}$ applied conductive rubber roller.

FIGS. 12 and 13 are graphs showing the results.

FIG. 12 shows the relationship between the photosensitive member surface potential V after the contact-charging relative to the voltage $V_{DC}$ applied to the roller 2 with a parameter of the photosensitive member surface potential V1 before the contact charging. The results are summarized as follows:

I-i. When the difference between the photosensitive member surface potential V1 before the contact charging and the voltage $V_{DC}$ applied to the roller 2 is within ±550 V range, the photosensitive member surface potential V after the contact charging is equal to the surface potential V1: and I-ii. When the difference is larger than ±550 V,
if $V_{DC}-V1 \leqq -550$ V, $V=V_{DC}-(-550)$ V,
if $V_{DC}-V1 \leqq +550$ V, $V=V_{DC}-(+550)$ V.

FIG. 13 shows a relationship between a photosensitive member surface potential after the contact charging relative to the photosensitive member surface potential V1 before the contact charging with a parameter of a voltage $V_{DC}$ applied to the roller 2. The results are summarized as follows:

II-i. When the difference between the photosensitive member surface potential V1 before the contact charging and the voltage $V_{DC}$ applied to the roller 2 is not more than ±550 V, the potential V after the contact charging is equal to the voltage V1 before the contact charging (V=V1): and II-ii. If the difference is outside ±550 V region, the potential V is substantially constant, as follows:
$V=V_{DC}-(-550)$ V $(V1>(V_{DC}-(-550))$ V
$V=V_{DC}+(-550)$ V $(V1<(V_{DC}+(-550))$ V.

The above described results I-i, I-ii, II-i and II-ii are further summarized as follows:

III-i. When the absolute value of a difference between the photosensitive member surface potential V1 before the contact charging and the voltage $V_{DC}$ applied to the roller is not more than 550 V, the photosensitive member surface is neither charged nor discharged, and the potential V1 before the contact charging is maintained:

III-ii. When the absolute value of the difference is more than 550 V, the difference between the photosensitive member surface potential V after the contact charging and the applied voltage $V_{DC}$ is stably 550 V.

Therefore, it is understood that in order for electric charge to move between the roller 2 and the surface of the photosensitive member, at least 550 V of the potential difference is required, and the charge moves until the potential difference becomes 550 V, and then the stabilized state is reached.

The potential difference of 550 V is a charge transfer starting potential difference $V_{TH}$ of the photosensitive member used in this embodiment. This can be obtained by the Paschen's law.

Figure 14:
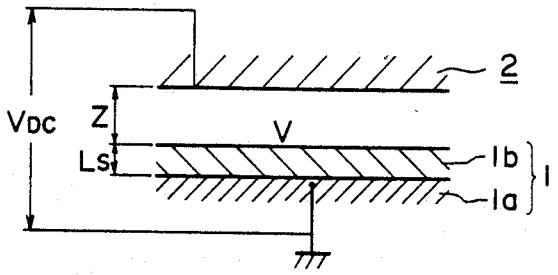
FIG. 14 is a model of a gap formed between the photosensitive layer and the conductive roller.

FIG. 14 is a simulation model of the conductive roller 2 and the photosensitive layer 1*b*. A voltage Vg applied across the microscopic gap Z is, $$Vg=|V_{DC}-V|Z/(Ls/\epsilon s+Z) \ldots \quad (1)$$

$V_{DC}$: voltage applied to the roller
V: surface potential of the photosensitive member
Z: gap
Ls: thickness of the photosensitive layer
$\epsilon s$: relative dielectric constant of the photosensitive layer Discharge in the gap Z is approximated by the Paschen's law in the range of Z=8–100 microns, by the following equation:

$$Vb=312+6.2Z \ldots \quad (2)$$

where Vb is a gap break-down voltage.

Figure 15:
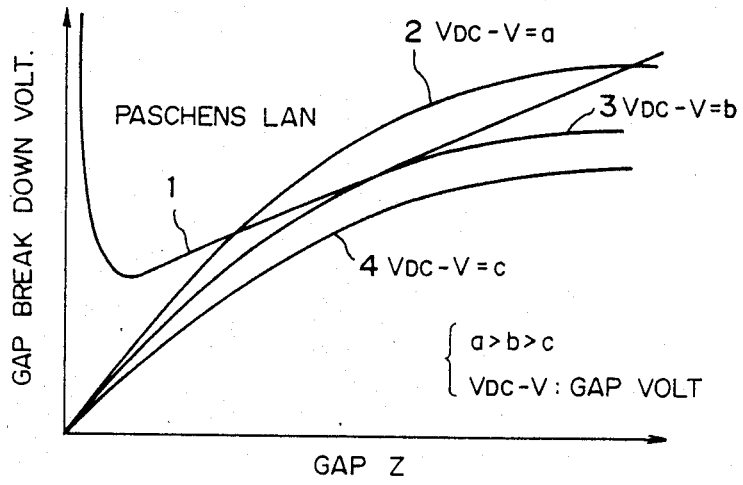
FIG. 15 is a graph showing a relation between the gap voltage and the Paschen's law curve.

FIG. 15 is a graph on which the equations (1) and (2) are plotted as an air gap break-down voltage or gap voltage as a function of the gap Z. In the graph, reference numeral 1 designates a Paschen's curve which is convex-down, and reference numerals 2, 3 and 4 designate the gap voltages (Vg) curves which are convex-up with a parameter of ($V_{DC}-V$). The minimum requirement for the occurrence of the charge transfer is represented by the intersection between the Paschen's curve 2, 3 or 4. At the point of the discharge start, a discriminant of a quadratic of Z given by Vg=Vb=0, that is, $$(|V_{DC} - Vd| - 312 - 6.2 \times (Ls/\epsilon s))^2 = 4 \times 6.2 \times 312 \times Ls/\epsilon s$$

Therefore, $$|V_{DC} - Vd| = \sqrt{7737.6 \times Ls/\epsilon s} + 312 + 6.2 \times Ls/\epsilon s = V_{TH} \quad (3)$$

When the dielectric constant $\epsilon s=3$ of the OPC photosensitive layer 1*b* and the thickness of 19 microns of the CTL layer are substituted into the right side of the equation (3), the following results $$V_{TH}=573 \text{ V.}$$

This is generally the same as the equation obtained from experiments, that is, 550 V.

Here, the charge starting voltage is determined from the results of the measurements in the following manner. The charging member is contacted to a member to be charged having a surface potential of zero, and only a DC voltage is applied to the charging member. The DC voltage is increased, and the surface potential of the member to be charged is plotted in the surface potential vs applied DC voltage graph. The voltages are plotted with increment of 100 V. The first plot of the voltage is the one which the first potential of the member to be charged appears, and ten surface potentials are plotted at each 100 V increment. Using least square approximation, a straight line is drawn from the plots. The DC voltage leading at which the straight line and the line representing the zero surface potential cross is deemed as the charge starting voltage.

Figure 16:
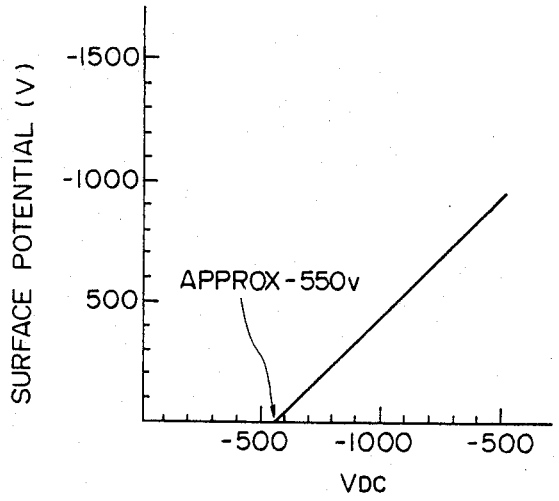
FIG. 16 is a graph of a surface potential of the member to be charged and a DC voltage applied to a charging member.

FIG. 16 is a graph illustrating an example of the above method, the charge starting voltage was −550 V in this embodiment. The charge starting voltage is different if the member to be charged is different.

In the contact type charging, there are the above-described relationships among the surface potential of the member to be charged before the contact charging, the potential difference at the time of the charge transfer start and the surface potential of the member to be charged after the contact charging. In consideration of those, the present invention uses transfer means for providing a surface potential which is not less than a predetermined uniform charging potential after the transfer and a discharging member supplied with a voltage or grounded to be contacted to the surface of the image bearing member charged by the transfer means and to discharge it to a substantially uniform predetermined potential. Therefore, the desired surface potential of the image bearing member is provided by the transfer means and the discharging member.

By the charging means, the surface of the image bearing member is charged to a potential of V1 so as to satisfy the following:

$$V1 \geqq V2+V_{TH} \text{ (V1 and } V_{TH} \text{ are positive)} \quad \ldots \text{(I)}$$

$$V1 \leqq V2+V_{TH} \text{ (V1 and } V_{TH} \text{ are negative)}$$

where V2 is a potential of the discharging member ($=V_{DC}$).

That is, the image bearing member surface is overcharged. By this, the surface potential V of the image bearing member after passing by the discharging member maintained at the potential of V2 is made uniform to be $V=V2+V_{TH}$ irrespective of the level of the voltage V1. The above two inequations are summarized as follows:

$$|V1-V2| \geqq V_{TH} \ldots \quad \text{(I)}'$$

In addition, as contrasted to the case where a charging roller charges the image bearing member from non-charged state, more uniform charging can be provided by once charging the image bearing member and then discharging it.

Figure 1:
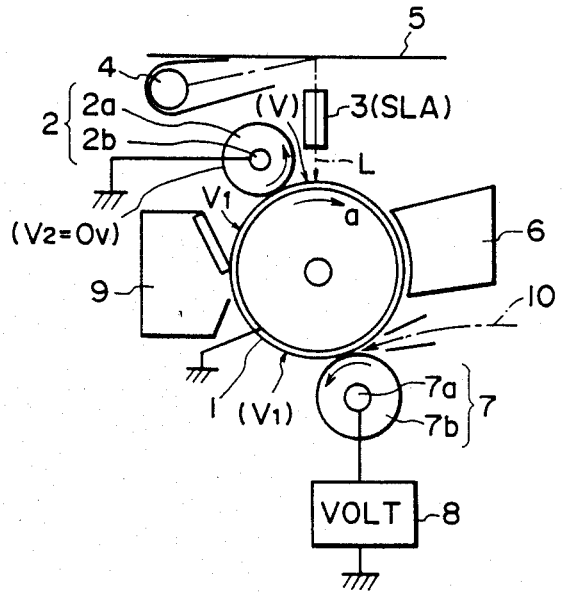
FIG. 1 is a sectional view of an image forming apparatus according to an embodiment of the present invention.

Referring now to FIG. 1, there is shown an electrophotographic copying apparatus as an exemplary image forming apparatus according to an embodiment of the present invention.

The image forming apparatus comprises an electrophotographic photosensitive member in the form of a drum rotatable at a predetermined peripheral speed in the direction indicated by an arrow about a central axis. It is a negative OPC photosensitive drum as described hereinbefore, and therefore, it has a CTL layer having a thickness of 19 microns (Ls), a dielectric constant of approximately 3 ($\epsilon s$) and a potential difference of charge transfer start of 550 V ($V_{TH}$). A conductive roller 2 as the discharging member is contacted to the surface of the photosensitive drum 1 under a predetermined pressure. The conductive roller 2 used in this embodiment is a conductive rubber roller having a core metal 2*a* and a conductive rubber layer 2*b* thereon. The volume resistivity of the rubber 2*b* is $10^2$ ohm.cm. The volume resistivity may be $10^{\circ}$–$10^4$ ohm.cm.

Figure 2A:
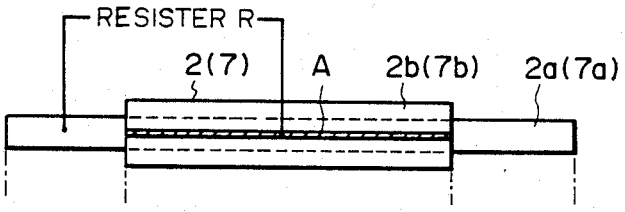
FIGS. 2A and 2B illustrate a method of measuring an electric resistance of a conductive rubber roller as a conductive member.
Figure 2B:
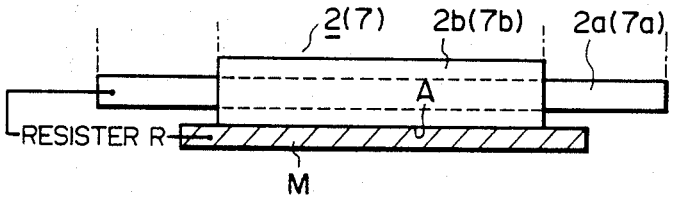

A resistance of the entire roller 2 is $10^4$ ohm –$10^7$ ohm in this embodiment. The resistance is, as shown in FIGS. 2A and 2B, a resistance between a core metal of the roller 2*a* and a metal electrode M corresponding to a width A of the nip formed between the drum 1 and the roller 2 press-contacted to the photosensitive drum 1 surface with a predetermined pressure.

The conductive rubber roller 2 is rotated following the rotation of the photosensitive drum 1. The core metal 2*a* of the conductive rubber roller 2 is grounded, and therefore, the surface potential V2 ($V_{DC}$) of the roller is maintained at 0 V.

As will be described hereinafter, the surface of the photosensitive drum 1 is charged to a predetermined uniform negative potential by being passed by the conductive roller 2.

In the image forming apparatus, the original 5 to be copied is placed face down on an unshown reciprocable original supporting platen glass, or is transported by an unshown pair of rollers with the image surface facing down at a speed synchronized with the rotation of the photosensitive drum 1. During the movement of the original, the image bearing bottom surface of the original is illuminated by a lamp 4, and the light reflected by the surface of the original is imaged through a short focus lens array (SLA) 3 on the surface of the photosensitive drum 1 after passing by the conductive rubber roller 2. By this, the surface of the photosensitive drum 1 is exposed to the image light, so that an electrostatic latent image is formed. The image exposure of the photosensitive drum 1 may be performed by a laser beam scanning device, an LED array, a liquid crystal shutter array or the like controlled by time-series electric picture element signals to expose the photosensitive member to the image information. A developing device 6 develops (ordinary development) the electrostatic latent image on the surface of the drum by a positive (opposite to the polarity of the charge of the photosensitive drum 1 surface) toner.

Designated by a reference numeral 7 is a conductive roller functioning as the transfer means. The conductive roller 7, which will hereinafter be called "first roller" has the same structure and dimensions as the conductive roller 2 functioning as the discharging member, which will hereinafter be called "second roller". The first roller is contacted to the surface of the photosensitive drum 1 with a predetermined pressure, and is rotated following the rotation of the photosensitive drum 1. To the core metal 7a of the first roller 7, a negative (opposite to the plurality of charge of the toner) voltage is applied from the voltage source 8. By an unshown feeding station, a transfer material 10 is introduced into the nip formed between the photosensitive drum 1 and the first roller 7, so that the toner image is transferred sequentially from the surface of the photosensitive drum 1 to the surface of the transfer material 10.

The transfer material 10 now having an image transferred thereto is separated from the surface of the photosensitive drum 1 and is directed to an unshown fixing device, where the image is fixed. Then, the transfer material is discharged outside the image forming apparatus as a copy.

After the image transfer, the surface of the photosensitive drum 1 is cleaned by a cleaning device 9 so that the residual toner or the like thereon is removed to be prepared for the repeated image formation.

Figure 3A:
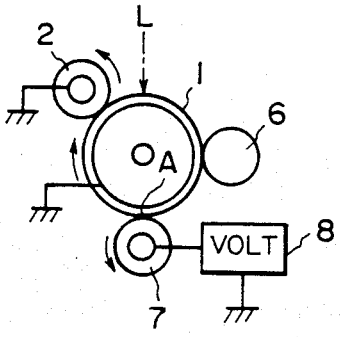
FIGS. 3A–3F are sectional views illustrating cyclic rotation of the photosensitive drum.
Figure 3B:
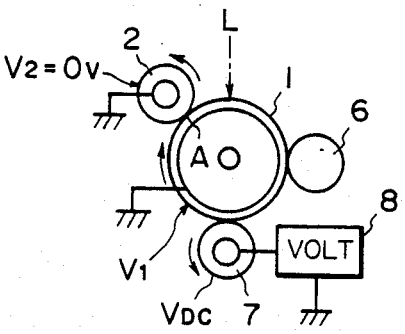
Figure 3C:
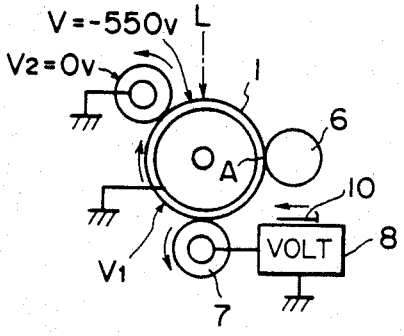
Figure 3D:
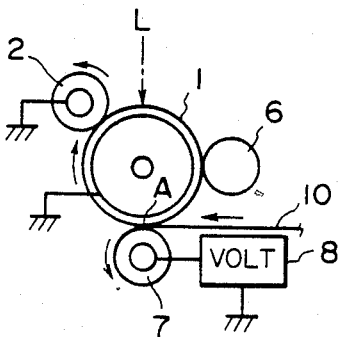
Figure 3E:
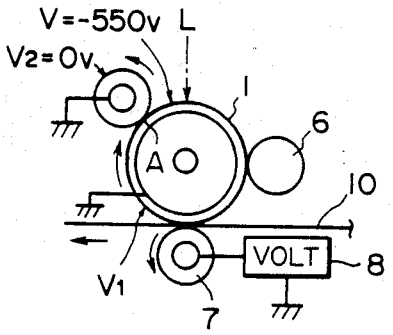
Figure 3F:
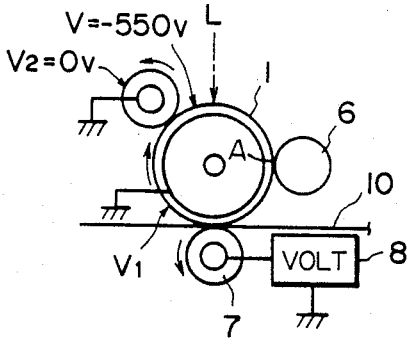
Figure 4:
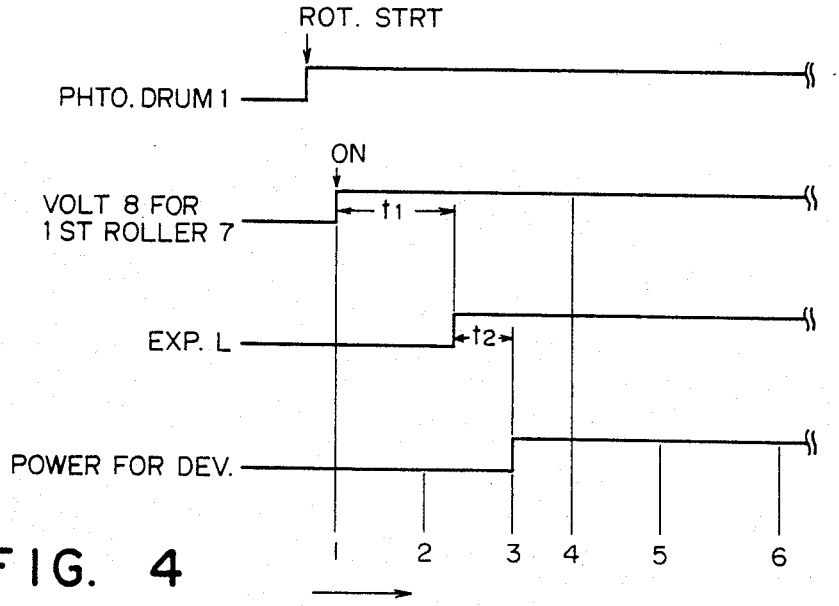
FIG. 4 is a timing (sequence) chart illustrating an image forming process.

FIGS. 3A–3F show cyclic operation of the photosensitive drum, and FIG. 4 is a timing (sequence) chart of the image forming process.

When a start signal is given to the control system of the apparatus, the photosensitive drum 1 starts to rotate at a predetermined peripheral speed. Then, the first and second rollers 7 and 2 are rotated by the photosensitive drum 1 which is press-contacted thereto under the predetermined pressure.

(1) At the time indicated by a reference 1 in FIG. 4, the voltage source 8 for applying voltage to the first roller 7 is energized. The position on the photosensitive drum 1 surface which is contacted to the first roller 7 at this time is taken as a reference position A (FIG. 3A) for the convenience of explanation. The voltage $V_{DC}$ applied to the first roller 7 is not less than −1.1 KV (this means that the absolute value of the voltage is not less than 1.1, in other words, the level of the voltage is not less than 1.1 KV), and therefore, the portion of the photosensitive drum 1 surface passing by the first roller 7 acquires the surface potential V1 of not less than −550 V ($V_{DC}+V_{TH}$)=the charge transfer start voltage $V_{TH}$ of the photosensitive drum is 550 V in this embodiment).

(2) With the continuing rotation of the photosensitive drum 1, the reference position A reaches the position of the second roller 2 (see reference numeral 2 in FIG. 4, and see FIG. 3B). Thereafter, the position of the photosensitive drum 1 surface passing by the second roller 2 acquires uniformly −550 V (=$-V_{TH}$) since the second roller 2 is grounded, and the surface potential $V2=V_{DC}=0$ V.

(3) When the reference position A reaches the exposure station, the image exposure L is started, so that an electrostatic latent image is sequentially formed on the basis of the image exposure on the surface following the reference position A.

When the reference position A of the photosensitive drum 1 reaches a position where it is opposed to a developing member such as a developing roller or a developing sleeve of the developing device 6 (reference 3 of FIG. 4, FIG. 3C), an unshown power source for the development is energized, by which the electrostatic latent image on the photosensitive drum 1 is sequentially developed with toner positively charged through a process such as a so-called jumping development. In this embodiment, the polarity of the charging means is the same as the charging polarity of the image bearing member after passing by the charging member, and therefore, the developing means performs a regular development. Then, the possible memorizing effect by application of the charge having the polarity opposite to that of the charging polarity of the image bearing member to the image bearing member, does not result (4) An unshown sheet feeding station supplies a transfer material 10 at such a timing that when the reference position A of the photosensitive drum 1 reaches the first roller 7 (see reference 4 of FIG. 4, and see FIG. 3D), the leading edge of the transfer material 10 reaches a nip between the photosensitive drum 1 and the first roller 7. Then, the transfer of the toner image from the photosensitive drum 1 to the transfer material 10 starts, during which the first roller 7 functions as a transfer roller. The portion of the transfer material having passed by the first roller 7 is separated from the photosensitive drum 1, and is conveyed to an unshown image fixing device.

Figure 5:
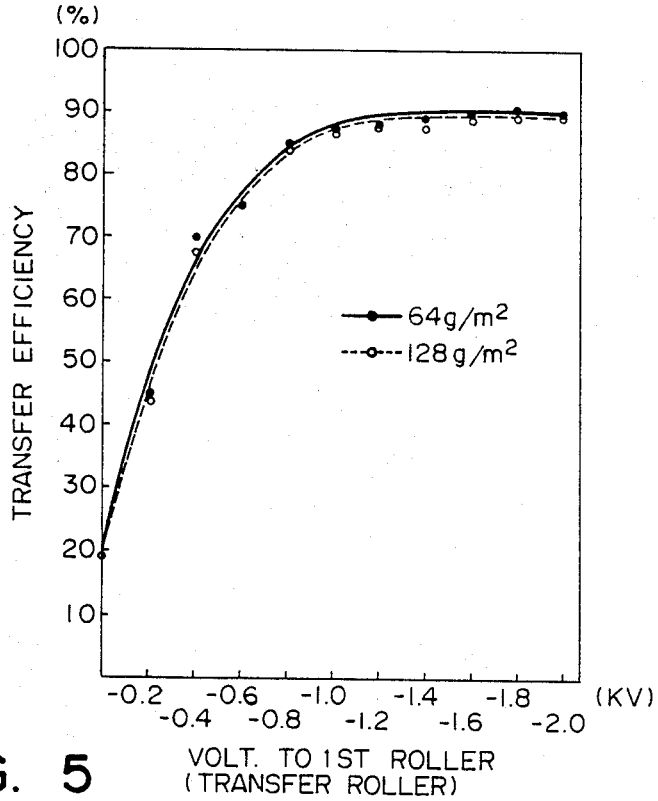
FIG. 5 is a graph of an image transfer efficiency vs. a voltage applied to a first roller.

FIG. 5 is a graph of efficiency of toner transfer from the drum surface to the transfer material 10 relative to a voltage applied to the first roller 7. The transfer efficiency is saturated to be approximately 90% at a voltage level of not less than −1.1 KV for either of the transfer sheets having the basis weights of 64 g/m$^2$ and 128 g/m$^2$.

Figure 6:
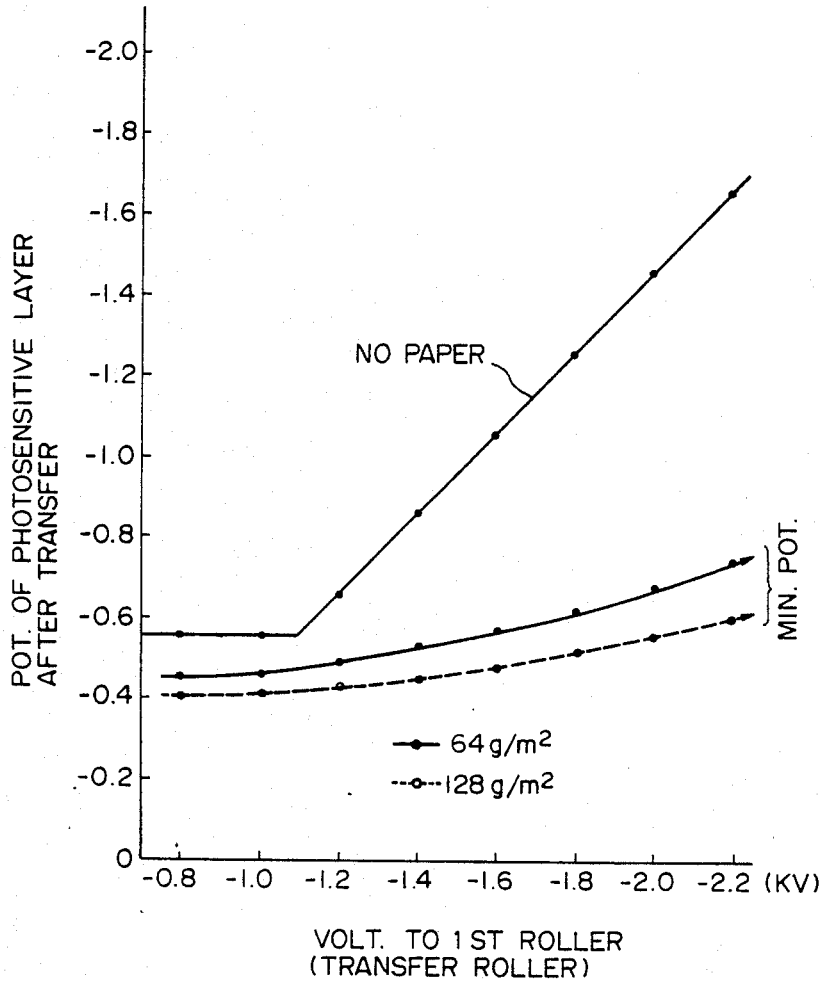
FIG. 6 is a graph of a surface potential of a photosensitive drum after image transfer vs. a voltage applied to a first roller.

The minimum of the surface potential of the photosensitive drum 1 after the image transfer is as shown in FIG. 6. It is desirable in order to perform the next image forming operation that the surface of the photosensitive drum 1 reaches the second roller 2 with its surface potential V1 not less than −550 V. The graph of FIG. 6 indicates that the voltage applied to the first roller 7 is not less than −1.8 KV at least during the transfer material 10 being passed by the roller when the basis weight of the transfer material is 64 g/m$^2$, and it is not less than −2.2 KV when the basis weight of the transfer material is 120 g/m$^2$, in order to obtain the surface potential of the photosensitive drum after the image transfer which is not less than −550 V.

To accomplish this, the following control is carried out. At least during the transfer material 10 passing by the position of the first roller 7 as the transfer roller, the voltage applied to the roller 7 is either not less than −1.8 KV or not less than −2.2 KV depending on the basis weight of the transfer material, and after the trailing edge of the transfer material 10 passing by the first roller 7 position, the voltage is switched to −1.1 KV. If the voltage is not changed, such a voltage is applied to the first roller 7 that the surface potential V1 of the photosensitive drum 1 surface becomes not less than −550 V.

Figure 7A:
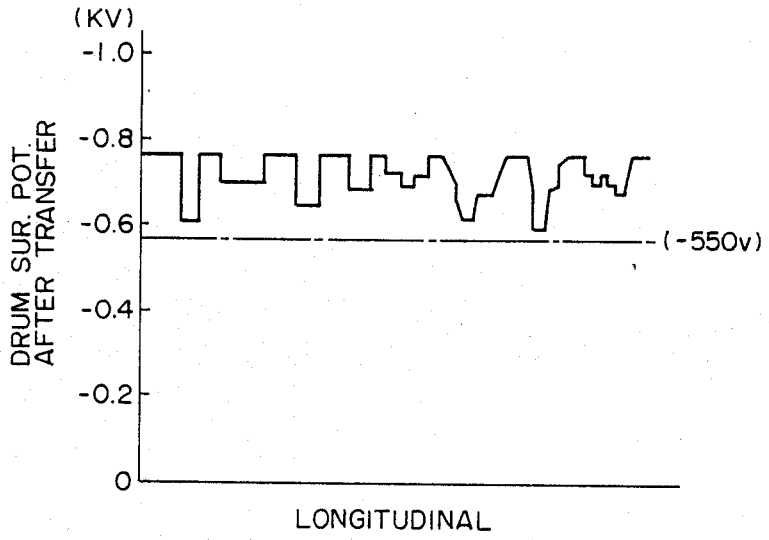
FIG. 7A shows a distribution of a photosensitive drum surface potential along the length of the drum after the image transfer.
Figure 7B:
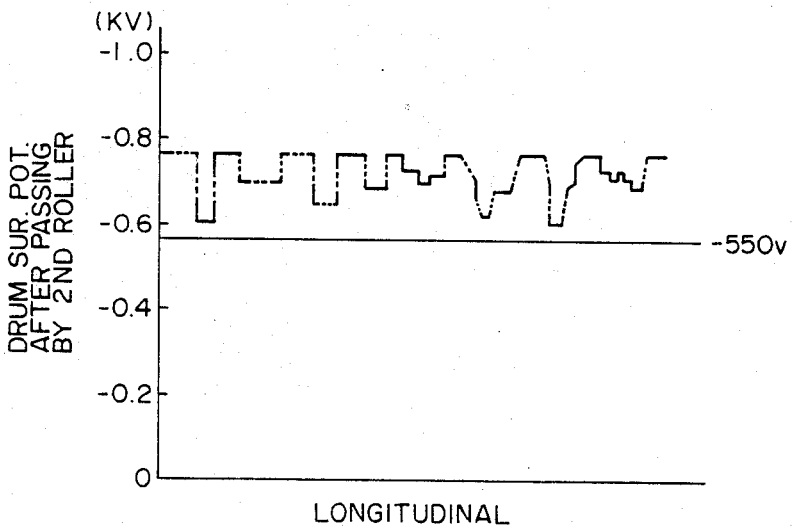
FIG. 7B shows a distribution of a photosensitive drum surface potential along the length of the drum after passing by a second roller.

(5) In this manner, the surface of the photosensitive drum 1 after the image transfer having a surface potential V1 which is not less than −550 V as shown in FIG. 7A reaches the second roller 2 (see reference 5 in FIG. 4, and see FIG. 3E). By passing by the roller 2, the surface potential is made uniform to be −550 V as shown in FIG. 7B. This is as if unmoved lawn is mowed. The photosensitive drum is again exposed to image light L, so that an electrostatic latent image is formed, which is developed by the developing device 6 (see reference 6 in FIG. 4, and see FIG. 3F).

The image forming process is repeated in this manner, and a good image can be produced through one process even if the peripheral circumferential length of the photosensitive drum 1 is shorter than the length of the intended image (the length of the transfer material 10).

In this embodiment, the second roller 2 as the discharging member is grounded, so that the surface potential V2 of the roller 2 is made zero, but the roller 2 may be supplied with a voltage from a voltage source. For example, the surface potential V2 is −150 V, the surface potential V of the photosensitive drum 1 is −700 V (=−550 V+(−550 V)) after passing by the roller 2. As will be understood, even in the system in which a voltage is applied to the second roller 2, such a low voltage source is enough which provides an output voltage which alone is not enough to charge the surface of the photosensitive drum 1 (not more than the charge transfer starting voltage difference $V_{TH}$), and the surface of the photosensitive drum 1 can be charged to a desired higher voltage (not less than $|V_{TH}|$).

When the thickness of the CTL layer of the photosensitive member is 30 microns, the charge transfer starting voltage difference $V_{TH}$ of the photosensitive member is 620 V. In this case, without any voltage applied to the second roller 2, the surface potential of the photosensitive member 1 is as high as −620 V after passing by the second roller. In this case, the surface potential of the photosensitive member V1 after the image transfer has to be not less than −620 V. The thickness of 30 microns is advantageous because the dielectric break-down is difficult.

As described, in the image forming apparatus according to this embodiment, the photosensitive drum surface potential is higher than the charge starting voltage thereof after the image transfer, and the surface of the photosensitive drum is discharged at the position after the transfer means by contacting the charging member 2 grounded or supplied with such a small voltage that it alone is not enough to charge the photosensitive member, to the photosensitive drum. Thus, the surface potential of the photosensitive member is made uniform before the image exposure. In addition, the transfer roller 7 is effective to assist the charging, and therefore, no additional charging device is required, thus reducing the cost and the size of the apparatus. Furthermore, the necessity, as in the conventional apparatus, of discharging means such as pre-exposure means acting on the photosensitive member before the uniform charging, is eliminated.

With the OPC photosensitive drum 1 used in this embodiment, the durability to the dielectric breakdown of the photosensitive member may be made sufficient if the thickness of the CTL layer is not less than 25 microns. When the thickness of the CTL layer is 19 microns, the voltage $V_{TH}$=550 V; when it is 25 microns, the voltage $V_{TH}$=580 V; and when it is 30 microns, the voltage $V_{TH}$ is 620 V, as described hereinbefore.

Figure 8A:
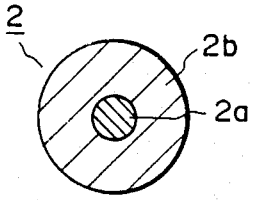
FIGS. 8A, 8B and 8C are sectional views of various types of first and second conductive rubber roller.
Figure 8B:
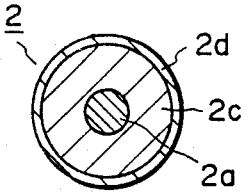
Figure 8C:
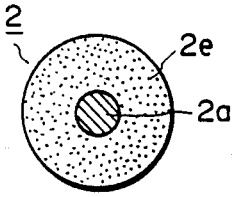

As examples of the first and second conductive rollers 7 and 2 (transfer means and discharging member) they each may have a core metal rod *7a* or *2a* and an elastic rubber layer *7b* or *2b* of EPDM, urethane, NBR or the like in which conductive material such as carbon is dispersed to provide the conductivity, as shown in FIG. 8A; may have a core metal rod *7a* or *2a* and an elastic layer *7c* or *2c* of sponge or rubber such as EPDM and NBR, and further a rubber layer *7d* or *2d* made of EPDM, urethane, NBR or the like in which carbon is dispersed at its peripheral surface portion to provide the conductivity; and may have a core metal rod *7a* or *7b* and a foamed urethane rubber layer *7e* or *2e* in which carbon is dispersed, as shown in FIG. 8C.

The second conductive roller 2 functioning as the discharging member may be in the form of a non-rotatable roller, a pad or a blade. When a roller is used, it is preferably rotated following the rotation of the photosensitive drum 1, since otherwise the photosensitive member surface is worn more quickly.

Figure 9:
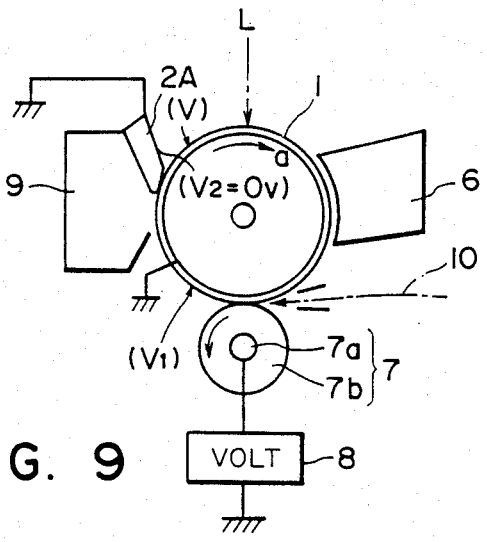
FIG. 9 is a sectional view of an image forming apparatus according to another embodiment of the present invention.

FIG. 9 shows an example of the apparatus, wherein the second conductive roller 2 of the apparatus of FIG. 1 is replaced with a conductive blade *2a*, which is formed integrally with the cleaning device 9. The blade *2a* is grounded, the other structure is the same as that of FIG. 1.

The same function and advantageous effects are provided in this example, and therefore, good images can be produced.

Figure 10:
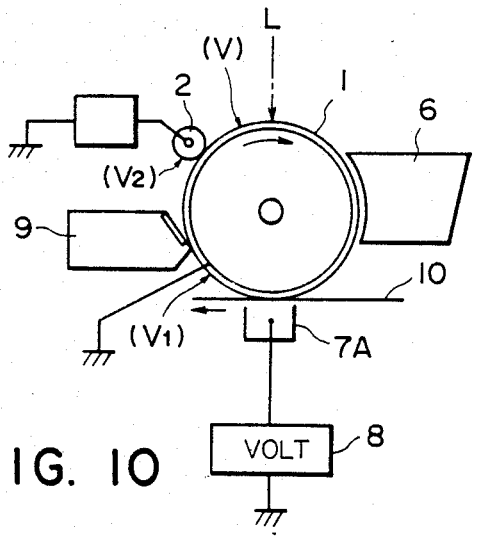
FIG. 10 is a sectional view of an image forming apparatus according to a further embodiment of the present invention.

FIG. 10 shows an example wherein the transfer means is in the form of a usual corona discharger 7A. In this case, the present invention is applicable, if the potential V1 after the image transfer is made not less than the intended voltage V. By this, the similar charged potential as in the foregoing embodiments can be provided, and therefore, the good image forming operation can be provided. Another form of transfer means such as transfer belt can be used with the same condition.

In this embodiment, a high voltage constant current source 8 may be employed to supply a constant current with a polarity opposite to that of the toner to the core metal *7a* of the first roller 7 (transfer roller). This modification will be described in more detail.

When a start signal is given to the control system of the apparatus, the photosensitive drum 1 starts to rotate at a predetermined peripheral speed G. In this embodiment, the speed G is 50 mm/sec. Then, the first and second rollers 27 and 2 are rotated by the drum 1 at the same peripheral speed since they are contacted to the photosensitive drum 1 under a predetermined pressure.

(1) At the time indicated by a reference 1 in FIG. 4, the high voltage constant current source 8 is energized to supply a voltage to the first roller 7. The position of the surface of the photosensitive drum 1 where the first roller 7 is contacted at this time is called a reference position A for the convenience of explanation (FIG. 3A).

By the energization of the source 8, the first roller 7 is supplied with a constant current I, and the surface of the photosensitive drum 1 rotating in contact with the first roller 7 is subjected to the contact-charging action. In this embodiment, the current I is 13 micro-ampere.

The current I is dependent on the surface moving speed (the predetermined peripheral speed on G on the drum 1) at the nip between the first roller 7 and the photosensitive drum 1 and on the length L of the nip. Therefore, the current I is changed in accordance with them, in accordance with the above teaching by one skilled in the art.

Figure 17:
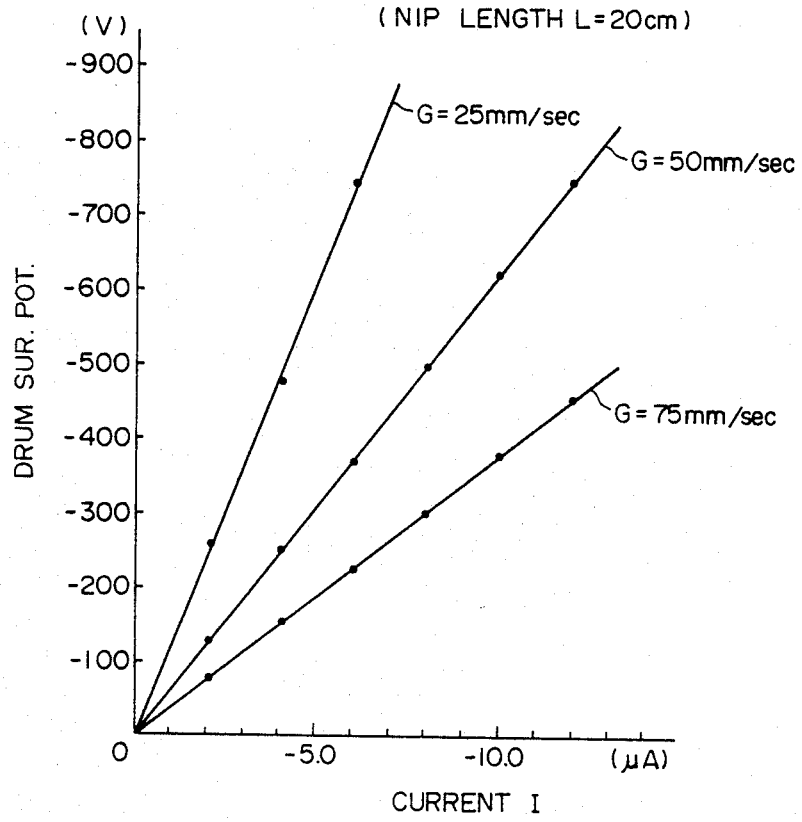
FIG. 17 is a graph of a photosensitive member surface potential charged by the roller vs. an electric current supplied to the first roller.

FIG. 17 shows a relationship between the current I supplied from the source 8 to the first roller 7 and the surface potential V1 of the photosensitive member charged by the first roller 7 with a parameter of the speed G, when the nip length L is 20 cm.

The relationship will be understood in consideration of a model, wherein a capacitor constituted by the nip between the photosensitive member 1 and the first roller 7 is charged sequentially with movement of the surface of the photosensitive member. Strictly speaking, the photosensitive member 1 is charged in the area where there is a small clearance between the first roller 7 and the photosensitive member 1, the charging region by the first roller 7 is slightly larger than the nip between the first roller 7 and the photosensitive member 1. However, the region of such a clearance is sufficiently negligibly small as compared with the nip, and therefore, the charging region by the first roller 7 is the same as the nip.

The electrostatic capacitance C' per unit width of the nip is $$C' = \epsilon 0 \epsilon s L / d \quad (4)$$

where L is a nip length; d is a thickness of the photosensitive member, more particularly, the thickness of the CTL layer; and $\epsilon s$ is a relative dielectric constant of the photosensitive member.

Then, the amount of charge Q per unit width of the nip is $$Q = C'V1 \quad (5)$$

where V1 is the surface potential of the photosensitive member charged by the first roller 7.

The relation between the relative surface moving speed G at the nip between the first roller 7 and the photosensitive member 1 and the current I is $$I = QG \quad (6)$$

From equations (4), (5) and (6)

$$I = G\epsilon 0 \epsilon s L V1 / d \quad (7)$$

Therefore, $$V1 = Id / G\epsilon 0 \epsilon s L \quad (7)'$$

From this equation, it is understood that the surface potential V1 of the photosensitive member 1 charged by the first roller 7 is proportional to the current I, and is inversely proportional to the relative surface moving speed G between the first roller 7 and the surface of the photosensitive member, the relative dielectric constant $\epsilon s$ of the photosensitive member and the nip length L.

Substituting G=50 mm/sec, $\epsilon s=3$, d=19 microns, L=20 cm, $\epsilon 0 = 8.854 \times 10^{12}\, cV^{-1}m^{-1}$ and I=11 micro-ampere, the results if V1 nearly equal 680 V. This is substantially equal to the actually measured value (FIG. 17). From this, if the current I is constant at −13 micro-amperes when the surface of the photosensitive member moves at a speed of G=50 mm/sec, the surface potential V1 at this stage becomes −800 V.

As described in the foregoing, if G=30 mm/sec, it is apparent that the current is one-half, that is −6.5 micro-amperes in order to charge it to −800 V.

(2) When the reference position A reaches the second roller 2 (charging member) by the continuing rotation of the photosensitive drum (reference numeral 2 in FIG. 4, FIG. 3B), the surface potential V1 of the photosensitive drum 1 passing by the second roller 1 is uniformized at an intended surface potential Vs=−550 V ($=-V_{TH}$), since the second roller 2 is grounded, and therefore, $V2=V_{DC}=0$ V. Here, if the second roller is supplied with a voltage V2, the absolute value of the surface potential of the photosensitive drum 1 having passed by the second roller 2, becomes $|V2+V_{TH}|$, and therefore, a potential higher than the absolute value $|V_{TH}|$ of the charge starting voltage.

Then, in the manner similar to described above, the reference position A of the photosensitive drum 1 is subjected to an image exposure operation at the exposure station so that an electrostatic latent image is formed, which is then developed by the developing device 6 (reference numeral 3 in FIG. 4, FIG. 3C). When the reference position A of the photosensitive drum 1 reaches the first roller 7, the toner image on the photosensitive drum 1 is transferred to the transfer material 10 surface. The subsequent operations are the same as described above, and therefore, the description will be omitted for the sake of simplicity.

Since the current I supplied to the first roller 7 is made constant at −13 micro-amperes in this embodiment, the voltage automatically changes with material or thickness of the sheet (transfer material 10). Without the transfer material 10, that is, when the photosensitive member 1 and the first roller 7 are directly contacted, it is 1.35 KV. With 64 g/m² sheet therebetween, it is −1.8 KV, whereas with 128 g/m² sheets therebetween, it is −2.2 KV.

If, for example, the current to the first roller 7 is set to −6 micro-ampere by the constant current high voltage source 8, and if the circumferential peripheral speed G of the photosensitive drum 1 is 25 mm/sec, the surface potential V1 of the photosensitive member 1 after the image transfer is not less than −740 V, as shown in FIG. 17. The image forming process is executed in the same manner as described with the foregoing embodiment, and good images are provided.

When the constant current source 8 is used for the first roller 7, the following results from equations (I') and (7').

$$|I| \geqq G\epsilon 0 \epsilon s L |V2+V_{TH}| / d \quad (8)$$

Since the electrostatic capacity C per unit area of the photosensitive member functioning as the image bearing member C equals $\epsilon O \epsilon s / d$, the inequation is $$|I| \geqq GCL |V2+V_{TH}| \quad (9)$$

As will be understood, the current I by the constant current voltage source 8 satisfies the inequation (9). If the discharging member is grounded, V2=0, and therefore, the inequation (9) is $$|I| \geqq GCL|V_{TH}| \quad (9)'$$

Figure 18:
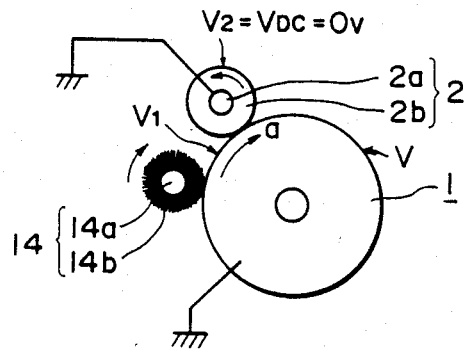
FIG. 18 is a sectional view of an image forming apparatus according to a further embodiment of the present invention.

FIG. 18 shows a further embodiment of the present invention, wherein reference numeral 1 designates an OPC photosensitive drum as the member to be charged, having a CTL layer having a thickness Ls of 19 microns, a relative dielectric constant $\epsilon s \simeq 3$, the charge transfer start voltage difference $V_{TH}$ of 550 V. The photosensitive drum 1 is rotated about the central axis in the direction a at a predetermined peripheral speed.

The apparatus includes a first charging means 14, which is in this embodiment a friction charging means. The friction charging means is a friction charging roller in the form of a brush which includes a shaft 14*a* made of plastic resin material and fibrous friction charging members 14*b* planted into the outer periphery thereof at a high density. Since the photosensitive member in this embodiment is a negatively chargeable OPC photosensitive member, the material of the friction charging members 14*b* are so selected that when they are frictioned with the surface of the photosensitive member, the surface of the photosensitive member is negatively charged. More particularly, in this embodiment, the material of the members 14*b* is nylon.

The conductive roller 2 is the same as that described with the foregoing embodiments, and therefore, the detailed description is omitted for simplicity. The photosensitive drum 1 during rotation thereof, it is electrically charged by the frictional charging roller 4 which is rotated in the opposite peripheral direction, so that the surface of the photosensitive drum 1 is charged to a negative polarity.

Figure 19A:
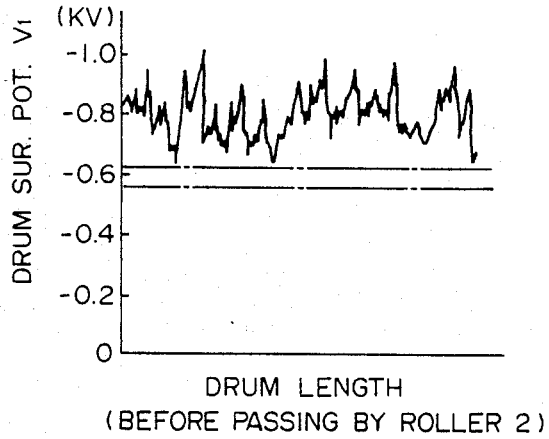
FIGS. 19A and 20A show distribution of the potential along the length of the drum, of the surface of an OPC (organic photoconductor) photosensitive member after frictional charging and before passing by the conductive rubber roller position.

FIG. 19A illustrates a distribution of the surface potential V1 along the length of the photosensitive drum (along the generating line of the photosensitive drum) friction-charged by the frictional charging roller 4.

The surface of the photosensitive member friction-charged is passed by the conductive rubber roller 2.

Figure 19B:
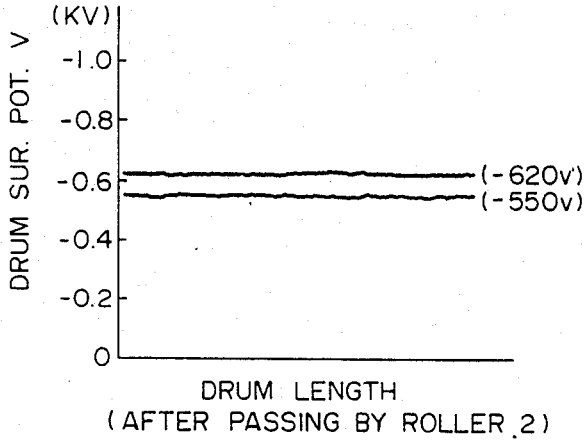
FIGS. 19B and 20B show potential distributions (along the length of the drum) of an OPC photosensitive member surface after passing by the conductive rubber roller position.

FIG. 19B shows a distribution of the surface potential V along the length of the photosensitive drum after passing by the roller 2. In this Figure, (1) indicates the case where the thickness of CTL layer is 10 microns ($V_{TH}$=550 V), whereas (2) indicates the case where the thickness of the CTL layer is 30 microns ($V_{TH}$=620 V).

Figure 20A:
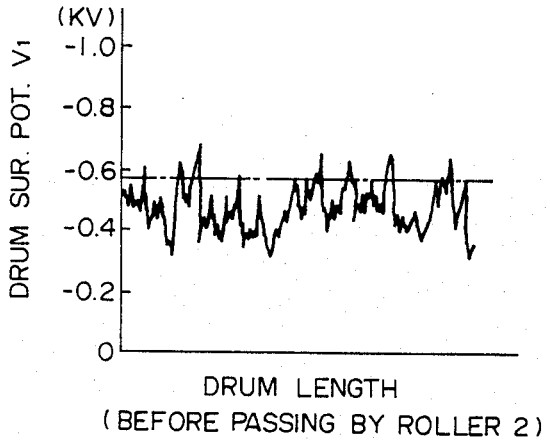
Figure 20B:
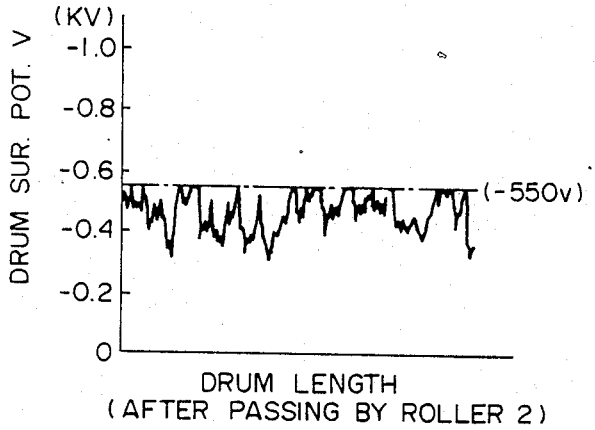

As will be understood from FIG. 19A, the surface potential of the photosensitive drum 1 is non-uniform after it is charged solely by the friction charging. However, after the surface of the photosensitive drum 1 passes by the conductive rubber roller 2, the surface potential V is uniform at V=−550 V along the entire length of the drum, as shown in FIG. 19B, (1), since the difference between the surface potential V1 (the potential provided by the frictional charging) of the photosensitive drum 1 and the surface potential V2 ($V_{DC}$=0 V) of the conductive rubber roller 2 is not less than the charge transfer starting voltage difference ($V_{TH}$=550 V) along the entire length of the drum. Thus, according to this embodiment, the surface of the photosensitive member (member to be charged) is electrically charged substantially uniformly to a desired voltage without any use of a power source. If the level of the frictional charging by the frictional charging means is so low as to result in the charge potential distribution as shown in FIG. 20A, for example, the surface potential V of the photosensitive member after passing by the conductive rubber roller 2 is such as shown in FIG. 20B ($V_{TH}$=550 V), and therefore, the surface potential is not made uniform. Therefore, the surface potential V1 of the photosensitive drum 1 after the friction-charging, has to be such that the difference between the potential V1 and the surface potential V2 ($V_{DC}$ of the conductive rubber roller 2 is not less than the charge transfer potential difference $V_{TH}$ of the photosensitive member used along the entire length of the drum).

When the photosensitive member is positively chargeable as in the case of amorphous silicon, the friction charging members 14*b* are preferably made of fluorine resin such as PTFE or PFA.

The frictional charging means 14 may not be in the form of the brush, but may be in the form of a roller having a shaft 4*a* and frictional charging members 4*b* thereon or in the form of a pad or the like.

Figure 21:
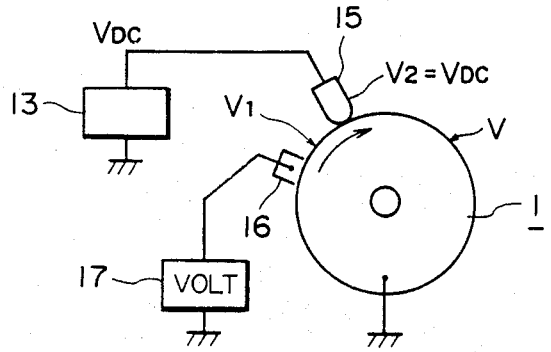
FIGS. 21–23 are sectional views of image forming apparatuses according to further embodiments of the present invention.

FIG. 21 illustrates a further embodiment of the present invention, wherein a reference numeral 16 designates a corona discharger (corotron) as the first charging means which is supplied with a voltage by a voltage applying source 17.

The apparatus includes a conductive member 15 which is a conductive rubber blade having a volume resistivity $10^2$ ohm.cm, and an electric resistance (of the blade) of $10^4$–$10^6$ ohm. The blade 15 is supplied with a voltage from a voltage applying source 13.

The photosensitive drum 1, during its rotation, is charged primarily by the corona discharger 16 to a surface potential of V1 and then is passed by the conductive blade 15. The first potential V1 of the photosensitive drum 1 surface provided by the corona discharger 16 is such that it is different from the surface potential V2 (=$V_{DC}$) of the blade 15 by not less than the charge transfer starting potential difference $V_{TH}$(=550 V) of the photosensitive member, as described hereinbefore.

Assuming that the potential V2 of the blade 15 is 0 V, the surface potential V of the photosensitive drum surface after passing by the blade 15 becomes $V_{TH}$, but if the blade 15 is supplied with the voltage $V_{DC}$ from the source 13 so that the surface potential of the blade is $V_{DC}$, the surface potential V is $V_{DC}+V_{TH}$.

More particularly, if the blade 15 is grounded ($V2=V_{DC}=0$ V), the surface potential V is −550 V, and if a voltage is supplied to the blade 15 from the source 13 so that $V_{DC}$=V2=−150 V, the surface potential V is −700 V.

Thus, even if the voltage is applied to the conductive member 15 by the source 13, the voltage source 13 is enough if it can supply to the conductive member the low voltage lower than $V_{TH}$, and there is no liability of production of the dielectric break-down of the photosensitive member by the leak current, and in addition, the surface potential of the photosensitive member can be rendered to be at a desired high potential uniformly.

If the distance between the drum 1 surface and the discharging wire 16*a* of the corona discharger 16 (first charging means) is not uniform along the length of the drum, the first charged potential of the drum is inclined along the length of the drum. Even if this occurs, the surface potential of the drum is uniform after passing by the conductive member.

Figure 22:
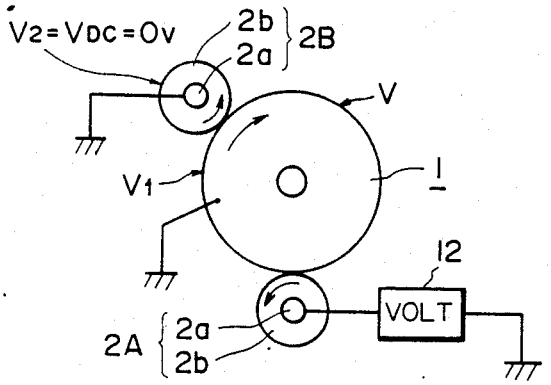

FIG. 22 shows a further embodiment, wherein a photosensitive drum 1 has a CTL layer having a thickness Ls of 30 microns, a relative dielectric constant $\epsilon s \simeq 3$ and a charge transfer starting potential difference $V_{TH}$=620 V. The drum 1 is made of an OPC material which is relatively chargeable.

The apparatus includes a conductive rubber roller (first roller) 2*a* as a first charging means and a conductive rubber roller 2*b* (second roller) as a second charging (discharging) means. The first and second rollers 2a and 2b each have a volume resistivity of $10^2$ ohm.cm, the entire resistance of $10^6$ ohm. The rollers are press-contacted to the drum 1 under a predetermined pressure, and is rotated by the rotation of the drum 1.

The first roller 2A has a core metal 2a which is electrically coupled with a voltage applying source 12, and is supplied with a voltage of −1.5 KV. The second roller 2B has a core metal 2b which is grounded.

The photosensitive drum 1, during its rotation, is contact-charged by the first roller 2A to a voltage V1 = −880 V (−1500−(−620)). Then, it is passed by the second roller 2B, by which the surface potential V becomes −620 V ($=V_{TH}$).

It is considered that in order to charge the surface of the photosensitive drum 1 to −620 V, one conductive roller is sufficient if the voltage of −1240 V is applied. However, in this case, there is a liability that some part of the surface is not charged, because only the DC voltage is applied thereto. In order to prevent this, the surface of the photosensitive drum is once charged to a potential higher than the target potential of the photosensitive drum by the first conductive roller 2A, and then the surface is discharged by the second conductive roller 2B, by which the non-uniform charged potential is made uniform.

Figure 23:
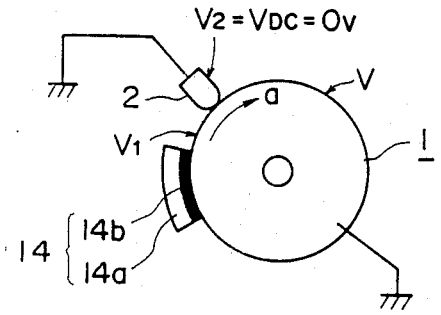

FIG. 23 shows a further embodiment of the present invention, wherein a photosensitive drum 1 (a member to be charged) is not made of the OPC material as contrasted to the foregoing embodiments, but is made of amorphous silicon (α-Si) as the photosensitive layer. The photosensitive layer has a thickness Ls of 20 microns and a dielectric constant εs of 12. By substituting those values into the above described equation (3) the charge transfer start potential difference $V_{TH}$ of the amorphous silicon photosensitive member is calculated out to be 432 V, which is substantially equal to the actually measured $V_{TH}$=440 V.

The first charging means 14 in this embodiment includes a base member 14a which has an inside surface having a curvature corresponding to the curvature of the outer surface of the drum 1 and fibers 14b made of material having high electrically negative property such as PTFE or the like planted into the inside surface of the base member 14a. The fibers 14b are contacted to the surface of the drum 1. When the drum is rotated, the surface of the drum is rubbed with the fiber materials, by which the surface of the drum is charged to a positive polarity.

The conductive member 2 in this embodiment is in the form of a conductive bar member having a semicircular cross-section, wherein the circular surface is contacted to the photosensitive drum, and the member 2 is grounded.

The surface of the photosensitive drum frictionally charged by the members 14b to a positive polarity is uniformized by the conductive member 2 to the potential of +400 V. In this embodiment, no power source is required. As will be understood, the surface of the member to be charged is uniformly charged to a positive potential.

According to the present invention, the member to be charged is economically and uniformly charged, if it is a photosensitive member such as Se and ZnO as well as OPC and amorphous silicon photosensitive members. The present invention is applicable also to another electrically chargeable member such as polyethylene terephthalate (Mylar) or other resin material other than the photosensitive material, and is capable of uniformly and economically charging the same.

In the foregoing embodiments, a dark decay which is attenuation of the potential of the image bearing member in the dark is negligible small, so that the dark decay has not been considered. Therefore, in FIG. 3, for example, the surface potential charged by the first roller 7 is considered as being equal to the surface potential of the image bearing member immediately before the second roller (charging member).

The conductive rollers used in the foregoing embodiments may have as a surface layer, for example, a thin layer having a thickness of several tens to several hundreds microns of the material having the volume resistivity of $10^8-10^{12}$ ohm.cm in order to prevent some spots are not electrically charged due to a leakage current if the image bearing member has a pin hole or holes.

As described in the foregoing, according to the present invention, the member to be charged is electrically charged by any charging means and then, the member thus charged is contacted to a discharging member, by which a desired potential is provided substantially uniformly over the entire surface of the member to be charged.

If the discharging member is grounded, there is no need of employing a voltage source. Even if the discharging member is supplied with a voltage, the voltage source is enough it provides a low voltage which is not more than the charge starting voltage of the member to be charged and which alone is not enough to charge the member to be charged, and therefore, it is economical. Additionally, according to one aspect of the present invention, the means required for uniformly discharging the image bearing member before the primary charge, which has conventionally been required can be eliminated. Additionally, the charging means can be an image transfer means. In this case, it is possible that the means required for the image transfer process can be utilized as the means for charging the image bearing member, and therefore, a simple image forming process is possible without a special charging device, and without the necessity of requiring two rotations of the photosensitive member for producing one copy. In this manner, the size and cost of the apparatus can be reduced. Further, if the transfer means is supplied from a constant current voltage source, the image transfer operation is effected with a proper voltage without consideration to the existence and non-existence of the transfer material at a transfer station and thickness and material of the transfer material in a transfer station, and the surface potential of the image bearing member after the image transfer can be maintained at V1 which is above a predetermined potential (=charge transfer start potential difference $V_{TH}$=potential V2 of the discharging member), and therefore, the surface potential of the image bearing member is uniform after it passes by the discharging member.

In addition, the dielectric break-down of the photosensitive member can be significantly prevented as compared with the case where a high transfer voltage is applied in order to make the surface potential V1 of the image bearing member after the image transfer higher than $V_{TH}$+V2 so as to meet various transfer materials.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus, comprising:

a movable image bearing member;

latent image forming means for forming a latent image on a surface of said image bearing member;

contact type charging means contactable to said image bearing member for charging said image bearing member before the latent image is formed on said image bearing member by said latent image forming means; and discharging means contactable to the surface of said image bearing member at a position between a latent image forming station having said latent image forming means and a charging station having said charging means where said image bearing member is electrically charged to discharge the surface of said image bearing member to provide a surface potential of said image bearing member having an absolute value which is not less than an absolute value of a charge starting voltage $V_{TH}$(V) of said image bearing member.

2. An apparatus according to claim 1, further comprising means for developing the latent image formed on said image bearing member by said latent image forming means and means for transferring the developed image from the surface of said image bearing member to a transfer material.

3. An apparatus according to claim 2, wherein said transfer means is a corona transfer means having a wire electrode and a shield electrode.

4. An apparatus according to claim 2, wherein said transfer means is a transfer roller contactable to said image bearing member.

5. An apparatus according to claim 2, wherein said transfer means has a charging polarity which is the same as a polarity of the latent image.

6. An apparatus according to claim 1, wherein said discharging means is grounded.

7. An apparatus according to claim 6, wherein a surface potential of said image bearing member immediately before contact with said discharging means V1 (V) satisfies $$|V1| \geqq |V_{TH}|.$$

8. An apparatus according to claim 7, wherein said charging means charges said image bearing member so that a surface potential of said image bearing member after passing by said charging means is not lower than |V1|(V).

9. An apparatus according to claim 7, wherein said transfer means includes a transfer member opposed to said image bearing member, and wherein a surface moving speed G (mm/sec) of the surface of said image bearing member and said transfer member, a length L (mm) of a discharge region wherein said image bearing member and said transfer member are opposed, measured along a length of said image bearing member, and an electrostatic capacity per unit area of said image bearing member, and a transfer current I(A), satisfy $$|I| \geqq GCL|V_{TH}|.$$

10. An apparatus according to claim 7, wherein said developing means develops the latent image with toner charged to a polarity opposite to a polarity of the latent image formed on said image bearing member by said latent image forming means.

11. An apparatus according to claim 3, wherein said discharging means is grounded.

12. An apparatus according to claim 11, wherein a surface potential of said image bearing member immediately before contact with said discharging means V1 (V) satisfies $$|V1| \geqq |V_{TH}|.$$

13. An apparatus according to claim 12, wherein said charging means charges said image bearing member so that a surface potential of said image bearing member after passing by said charging means is not lower than |V1|(V).

14. An apparatus according to claim 12, wherein said transfer means includes a transfer member opposed to said image bearing member, and wherein a surface of moving speed G (mm/sec) of the surface said image bearing member and said transfer member, a length L (mm) of a discharge region wherein said image bearing member and said transfer member are opposed, measured along a length of said image bearing member, and an electrostatic capacity per unit area of said image bearing member, and a transfer current I(A), satisfy $$|I| \geqq GCL|V_{TH}|.$$

15. An apparatus according to claim 12, wherein said developing means develops the latent image with toner charged to a polarity opposite to a polarity of the latent image formed on said image bearing member by said latent image forming means.

16. An apparatus according to claim 1, further comprising means for applying a predetermined voltage to said discharging means.

17. An apparatus according to claim 16, wherein said voltage applying means applies to said discharging means a voltage having an absolute value which is smaller than the absolute value of the charge starting voltage $V_{TH}$ (V) of said image bearing member.

18. An apparatus according to claim 16, wherein the predetermined voltage applied to said discharging means V2 (V) and a surface potential of said image bearing member V1 (V) immediately before contact with said discharging means, satisfy $$|V1-V2| \geqq |V_{TH}|.$$

19. An apparatus according to claim 18, wherein said charging means charges said image bearing member so that the surface potential of said image bearing member after passing by said charging means is not lower than |V1|(V).

20. An apparatus according to claim 18, wherein said transfer means includes a transfer member opposed to said image bearing member, and wherein a surface moving speed G (mm/sec) of the surface of said image bearing member and said transfer member, a length L (mm) of a discharge region wherein said image bearing member and said transfer member are opposed, measured along a length of said image bearing member, and an electrostatic capacity per unit area of said image bearing member, and a transfer current I(A), satisfy $$|I| \geqq GCL\ |V_{TH}+V_2|.$$

21. An apparatus according to claim 1, further comprising means for applying a voltage to said charging means.

22. An apparatus according to claim 1, wherein said image bearing member is a photosensitive member, and wherein said latent image forming means includes means for exposing said photosensitive member to image information.

23. An image forming apparatus comprising:

a movable image bearing member;

latent image forming means for forming a latent image on a surface of said image bearing member;

charging means for charging said image bearing member before the latent image is formed on said image bearing member by said latent image forming means;

discharging means contactable to the surface of said image bearing member at a position between a latent image forming station having said latent image forming means and a charging station having said charging means where said image bearing member is electrically charged to discharge the surface of said image bearing member to provide a surface potential of said image bearing member having an absolute value which is not less than an absolute value of a charge starting voltage $V_{TH}$(V) of said image bearing member; and means for developing the latent image formed on said image bearing member by said latent image forming means and means for transferring the developed image from the surface of said image bearing member to a transfer material;

wherein said transfer means also functions as said charging means.

24. An apparatus according to claim 23, further comprising means for applying a predetermined voltage to said discharging means.

25. An apparatus according to claim 24, wherein said voltage applying means applies to said discharging means a voltage having an absolute value which is smaller than the absolute value of the charge starting voltage $V_{TH}$(V) of said image bearing member.

26. An apparatus according to claim 24, wherein the predetermined voltage applied to said discharging means V2 (V) and surface potential of said image bearing member V1 (v) immediately before contact with said discharging means, satisfy $$|V1-V2| \geqq |V_{TH}|.$$

27. An apparatus according to claim 26, wherein said charging means charges said image bearing member so that the surface potential of said image bearing member after passing by said charging means is not lower than |V1|(V).

28. An apparatus according to claim 26, wherein said transfer means includes a transfer member opposed to said image bearing member, and wherein a surface moving speed G (mm/sec) of the surface of said image bearing member and said transfer member, a length L (mm) of a discharge region wherein said image bearing member and said transfer member are opposed, measured along a length of said image bearing member, and an electrostatic capacity per unit area of said image bearing member, and a transfer current I(A), satisfy $$|I| \geqq GCL\ |V_{TH}+V_2|.$$

29. An apparatus according to claim 23, wherein said transfer means is a corona transfer means having a wire electrode and a shield electrode.

30. An apparatus according to claim 23, wherein said transfer means is a transfer roller contactable to said image bearing member.

31. An apparatus according to claim 23, further comprising means for applying a voltage to said charging means.

32. An apparatus according to claim 23, wherein said image bearing member is a photosensitive member, and wherein said latent image forming means includes means for exposing said photosensitive member to image information.

33. An apparatus according to claim 23, wherein said developing means develops the latent image with toner charged to a polarity opposite to a polarity of the latent image formed on said image bearing member by said latent image forming means.

34. An apparatus according to claim 23, wherein said transfer means has a charging polarity which is the same as a polarity of the latent image.

35. An image forming apparatus, comprising:

a movable image bearing member;

latent image forming means for forming a latent image on a surface of said image bearing member;

charging means for charging said image bearing member before the latent image is formed on said image bearing member by said latent image forming means; and discharging means contactable to the surface of said image bearing member at a position between a latent image forming station having said latent image forming means and a charging station having said charging means where said image bearing member is electrically charged to discharge the surface of said image bearing member to provide a surface potential of said image bearing member having an absolute value which is not less than an absolute value of a charge starting voltage $V_{TH}$(V) of said image bearing member;

wherein said discharging means is grounded.

36. An apparatus according to claim 35, further comprising means for developing the latent image formed on said image bearing member by said latent image forming means and means for transferring the developed image from the surface of said image bearing member to a transfer material.

37. An apparatus according to claim 36, wherein said transfer means also functions as said charging means.

38. An apparatus according to claim 35, wherein a surface potential of said image bearing member immediately before contact with said discharging means V1 (V) satisfies $$|V1| \geqq |V_{TH}|.$$

39. An apparatus according to claim 38, wherein said charging means charges said image bearing member so that a surface potential of said image bearing member after passing by said charging means is not lower than |V1|(V).

40. An apparatus according to claim 38, wherein said transfer means includes a transfer member opposed to said image bearing member, and wherein a surface moving speed G (mm/sec) of the surface of said image bearing member and said transfer member, a length L (mm) of a discharge region wherein said image bearing member and said transfer member are opposed, measured along a length of said image bearing member, and an electrostatic capacity per unit area of said image bearing member, and a transfer current (IA), satisfy $$|I| \geqq GCL\ |V_{TH}|.$$

41. An apparatus according to claim 38, wherein said developing means develops the latent image with toner charged to a polarity opposite to a polarity of the latent image formed on said image bearing member by said latent image forming means.

42. An apparatus according to claim 36, wherein said transfer means is a corona transfer means having a wire electrode and a shield electrode.

43. An apparatus according to claim 36, wherein said transfer means is a transfer roller contactable to said image bearing member.

44. An apparatus according to claim 35, further comprising means for applying a voltage to said charging means.

45. A apparatus according to claim 35, wherein said image bearing member is photosensitive member, and wherein said latent image forming means includes means for exposing said photosensitive member to image information.

46. An apparatus according to claim 36, wherein said developing means develops the latent image with toner charged to a polarity opposite to a polarity of the latent image formed on said image bearing member by said latent image forming means.

47. An apparatus according to claim 36, wherein said transfer means has a charging polarity which is the same as a polarity of the latent image.

48. An image forming apparatus, comprising:

a movable image bearing member;

latent image forming means for forming a latent image on said image bearing member electrically charged to a predetermined potential level;

charging means contactable to said image bearing member to charge it to a potential level higher than the predetermined potential level before said latent image forming means forms the latent image; and means contactable to said image bearing member to lower the potential level to the predetermined level.

49. An apparatus according to claim 48, wherein said charging means functions also to transfer an image formed on said image bearing member before said latent image is formed, onto a transfer material.

* * * * *

UNITED STATES PATENT AND TRADEMARK OFFICE

CERTIFICATE OF CORRECTION

PATENT NO. : 4,959,688

DATED : September 25, 1990

INVENTOR(S) : NORIBUMI KOITABASHI

It is certified that error appears in the above-identified patent and that said Letters Patent is hereby corrected as shown below:

Title page,

IN [56] REFERENCES CITED

Insert: --3764207 10/1973 Obuchi ..... 355/219
4360262 11/1982 Genthe ..... 361/221--.

IN [57] ABSTRACT

Line 6, "id" should read --is--.
Line 13, "(V2=)" should read --(V2=0--.
Line 14, "charging" should read --charging means is--.

COLUMN 2

Line 68, "applied" should read --applied to the--.

COLUMN 3

Line 60, "roller 2:" should read --roller 2;--.

COLUMN 4

Line 8, "potential V1:" should read --potential V1;--.
Line 23, "charging (V=V1):" should read
--charging (V=V1);--.

COLUMN 8

Line 30, "result" should read --result.--.

--

UNITED STATES PATENT AND TRADEMARK OFFICE

CERTIFICATE OF CORRECTION

PATENT NO. :4,959,688

DATED :September 25, 1990

INVENTOR(S) :NORIBUMI KOITABASHI

It is certified that error appears in the above-identified patent and that said Letters Patent is hereby corrected as shown below:

COLUMN 16

Line 5, "negligible" should read --negligibly small--.
Line 29, "enough" should read --enough as--.

COLUMN 18

Line 1, "claim 3," should read --claim 23--.

COLUMN 19

Line 46, "member V1 (v)" should read --member V1 (V)--.

COLUMN 21

Line 25, "is" should read --is a--.

Signed and Sealed this

First Day of June, 1993

Attest:

Michael K. Kirk

MICHAEL K. KIRK

Attesting Officer

Acting Commissioner of Patents and Trademarks

--